US008303376B2

(12) United States Patent
Boselli et al.

(10) Patent No.: US 8,303,376 B2
(45) Date of Patent: Nov. 6, 2012

(54) DEVICE AND METHOD FOR POSITIONING AND BLOCKING STEADY RESTS FOR ROLLING MILL CYLINDERS IN GRINDING MACHINES AND GRINDING MACHINES EMPLOYING THE SAME

(75) Inventors: Giovanni Boselli, Magenta (IT); Flavio Stefano Bianchessi, Milan (IT); Fausto Candiani, Legnano (IT); Francesco Auteri, Oleggio (IT)

(73) Assignee: Tenova S.p.A., Milan (IT)

( * ) Notice: Subject to any disclaimer, the term of this patent is extended or adjusted under 35 U.S.C. 154(b) by 513 days.

(21) Appl. No.: 12/523,386

(22) PCT Filed: Jan. 18, 2008

(86) PCT No.: PCT/IB2008/000162

§ 371 (c)(1),
(2), (4) Date: Jul. 16, 2009

(87) PCT Pub. No.: WO2008/087551

PCT Pub. Date: Jul. 24, 2008

(65) Prior Publication Data

US 2010/0003899 A1 Jan. 7, 2010

(30) Foreign Application Priority Data

Jan. 19, 2007 (IT) ..... MI2007A0068

(51) Int. Cl.
*B24B 1/00* (2006.01)

(52) U.S. Cl. ..... 451/49; 451/406; 451/408

(58) Field of Classification Search ..... 451/49, 451/406, 408

See application file for complete search history.

(56) References Cited

U.S. PATENT DOCUMENTS 2,527,778 A * 10/1950 Trocki ..... 451/394
3,145,513 A 8/1964 Porath
3,762,106 A * 10/1973 Yuryan ..... 451/415

FOREIGN PATENT DOCUMENTS

EP 0 262 039 3/1988
JP 2003 266258 9/2003

OTHER PUBLICATIONS

Machine translation of JP 2003-266258.*

* cited by examiner

*Primary Examiner* — Maurina Rachuba
(74) *Attorney, Agent, or Firm* — Oblon, Spivak, McClelland, Maier & Neustadt, L.L.P.

(57) ABSTRACT

A device and method for positioning and blocking steady rests for rolling milly cylinders in grinding machines and grinding machines employing the same. A positioning and blocking device for steady rests includes a substantially flat carriage including a translation mechanism and a blocking mechanism, wherein the blocking mechanism is magnetic.

15 Claims, 2 Drawing Sheets

Fig. 3
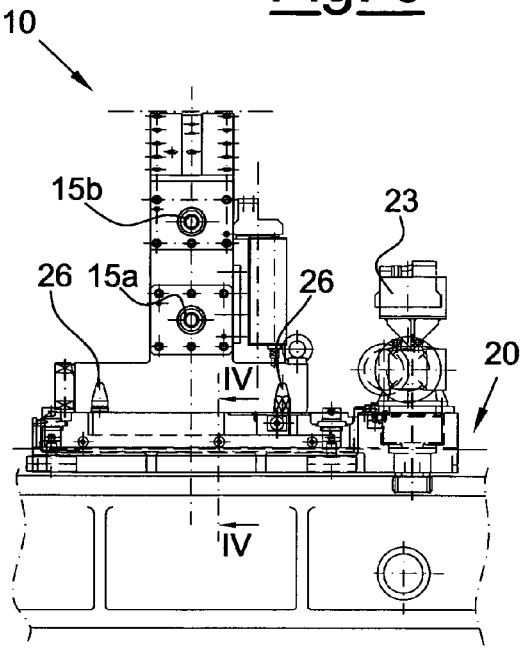
Fig. 4
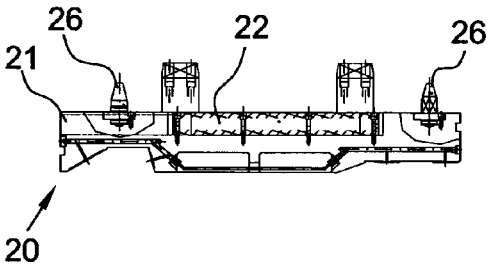
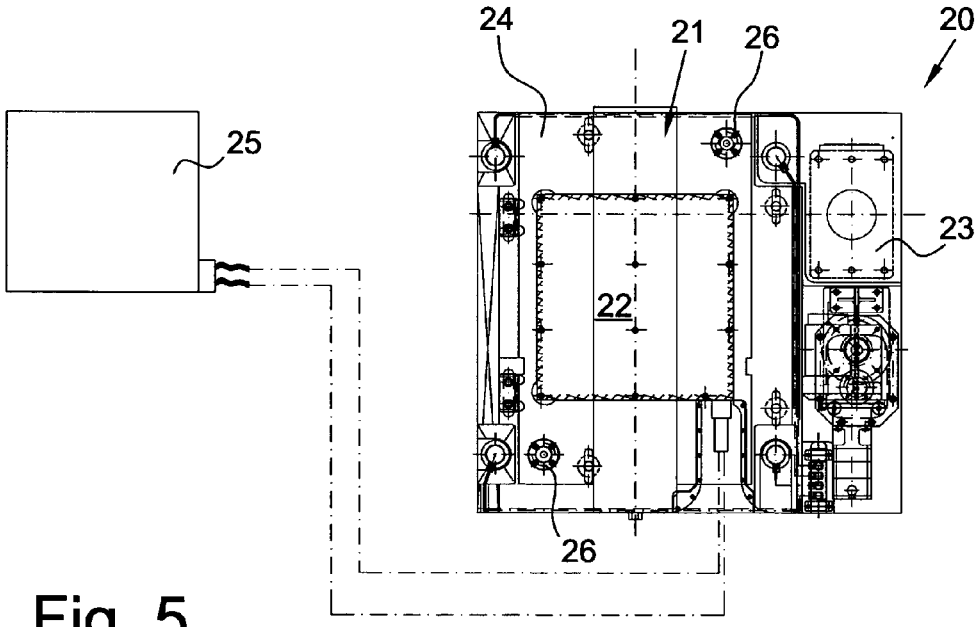
Fig. 5

DEVICE AND METHOD FOR POSITIONING AND BLOCKING STEADY RESTS FOR ROLLING MILL CYLINDERS IN GRINDING MACHINES AND GRINDING MACHINES EMPLOYING THE SAME

The present invention refers to a device and to a method of position and blocking steady rests for rolling mill cylinders in grinding machines and grinding machines employing the same.

Grinding machines for rolling mill cylinders are large equipments used in steel plants to recover the surface features and the structural integrity of the rollers used in the rolling stands with the aim of obtaining a long operation life and high quality of the sheets produced.

Often, such machines are provided with a non-destructive control system for determining and detecting defects, such as for example surface and or subsurface cracks, burns, flaws of different forms and so on, which can influence both the quality of the rolled product and also the life of the of cylinder.

The general procedure, especially on extremely slim cylindrical rollers, provides for the cylinder to be supported by devices, the so-called steady rests, which ensure the support of the cylinder with enough rigidity not to cause a defect on the shape of the profile.

The steady rests should be arranged when required in an ideal manner for each configuration of the roller. Their arrangement and fixing is usually performed manually or through hydraulic systems which operate on moveable blocking elements of the bases of the steady rests.

The current technique provides for automations of steady rests only in terms of their adaptation to the grinding conditions, while nothing has been done up to date regarding their initial positioning.

Given the remarkable difference in terms of shapes and dimensions of the cylinders to be grinded, whose diameter is usually established after the cylinder has been positioned on the machine, as of date, such requirement still needs that such positioning be performed by skilled operators.

Furthermore, the positioning operation is performed in the presence of oils, coolant materials and residues from the previous machining operations, for example abrasives and metal particles, which tend to deposit and settle at the steady rests movement zones.

Therefore, having to operate in particularly dirty environments, manual interventions require long periods of time for the performance of the steady rest adjustment operations, considerably influencing the overall production costs of the machine.

Additionally, such conditions represent a further limit to the use of automatic positioning of the steady rests in that they would be subject to extreme wear, thus requiring frequent cleaning and maintenance operations, due to the environment in which they would be required to operate.

In order to reduce the residues and the deposits in the movement areas of the steady rests masking and/or cleaning devices can be used, but their cost is such to make manual positioning more convenient.

The general objective of the present invention is that of overcoming the abovementioned drawbacks of the prior art in an extremely easy, inexpensive and particularly functional manner.

Another objective of the present invention is that of providing a technical solution capable performing the steady rest positioning operations in an easy, quick, clean and wear free manner.

Further objective of the present invention is that of finding a device and a method of positioning and blocking the steady rests capable of guaranteeing high automation of the overall grinding operation in the grinding machines.

Regarding the abovementioned objectives, according to the present invention, the idea was that of providing a device and a method of positioning and blocking of the steady rests, provided with the characteristics described in the claims attached.

In addition, it was deemed wise to manufacture grinding machines, particularly for rolling mill cylinders, employing the positioning and blocking device according to the invention.

Structural and functional characteristics and advantages of the present invention with respect to the prior art shall be clearer and more evident upon analysing the following description, with reference to the attached drawings, which show a positioning and blocking device of the steady rest made according to the innovative principles of the invention itself. In the drawings:

FIG. 3 is a view of a steady rest accommodated on a positioning and blocking device according to the invention seen from the side of FIG. 2;

FIG. 4 shows a section of the positioning and blocking device of the present invention along line IV-IV of FIG. 3;

FIG. 5 is a plan view of the positioning and blocking device according to the present invention.

Figure 1:
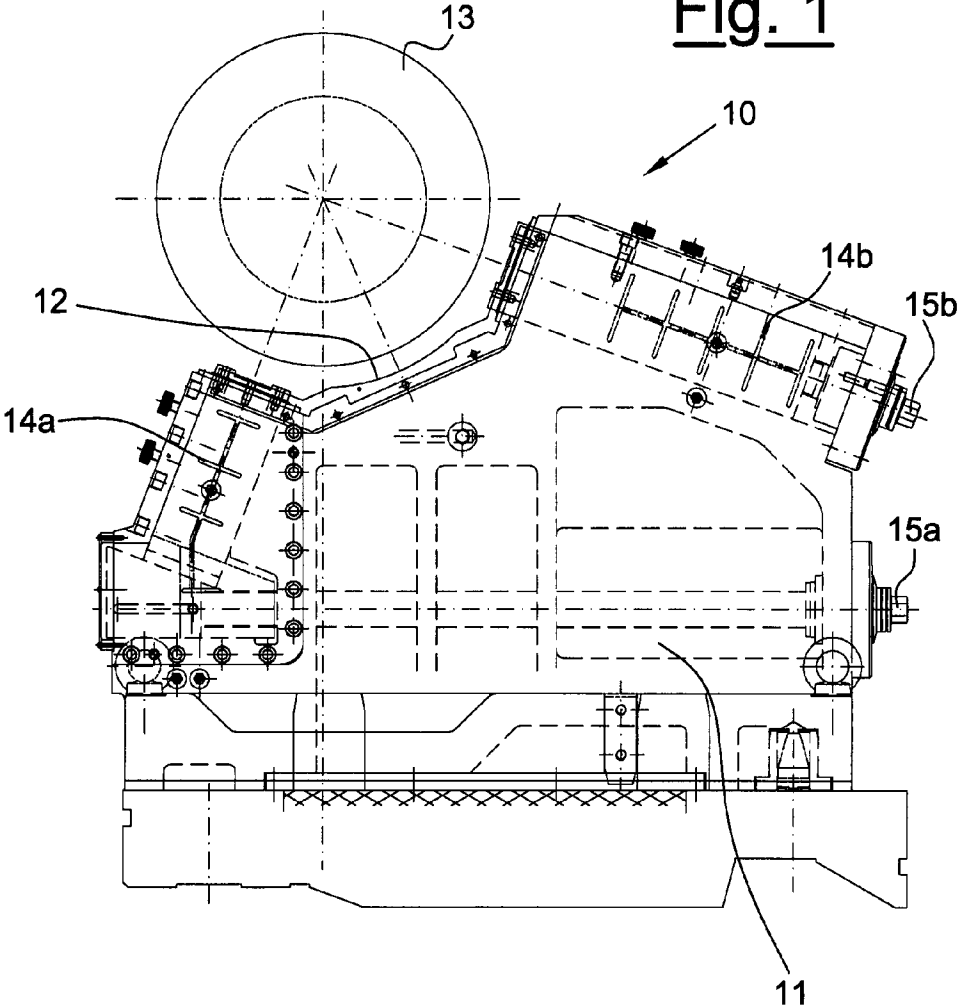
FIG. 1 shows a raised side view of a steady rest employing the positioning and blocking device of the present invention.
Figure 2:
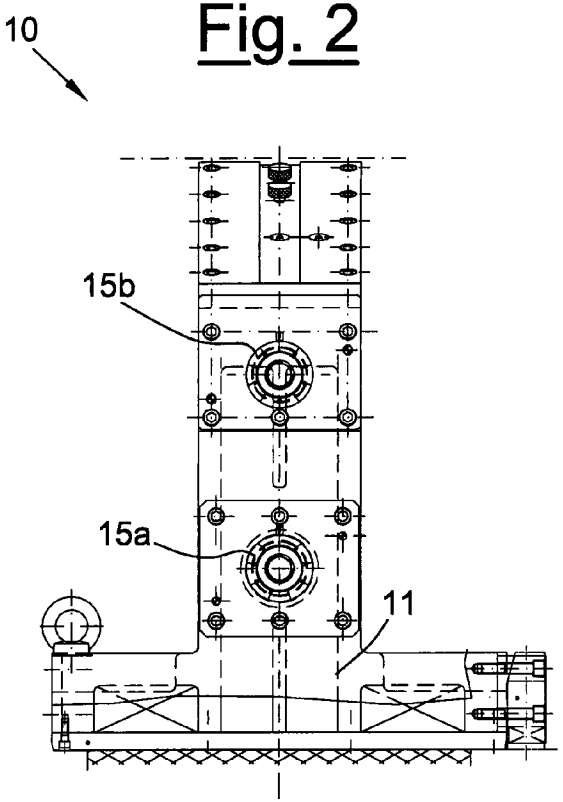
FIG. 2 is a view according to arrow F of the steady rest of FIG. 1.

With reference to the drawings, a steady rest employing the positioning and blocking device 20 subject of the invention is indicated in its entirety by 10, and in the illustrated example, according to the present invention, it comprises a support body 11 provided with a laying surface 12 for a rolling cylinder 13.

Furthermore, provided are at least two radially adjustable engagement means 14*a*, 14*b* for the engagement of the cylinder 13 to be grinded which, guided by their respective adjustment means 15*a*, 15*b*, project from the laying surface 12.

The steady rest 10 is accommodated in a removable manner on a positioning and blocking device 20 comprising a flat carriage 21 provided with a motorised translation means 23 for moving the steady rest 10 into position. Additionally, the positioning and blocking device 20 comprises centring pins 26 for accurate positioning of the body 11 of the steady rest 10 on the same and furthermore it is advantageously provided with magnetic blocking means 22, preferably made as a magnetic base 22 operating on the flat carriage 21 and accommodated in the same at the accommodation surface of the steady rest 10.

The use of a magnetic base 22 offers the advantage of avoiding the use of guides, holes or other solutions to obtain a safe blocking of the body 11 of the steady rest 10 against the carriage 21.

In order to guarantee such safe blocking between the body 11 of the steady rest 10 and the carriage 21, the magnetic base 22 comprises at least one suitably dimensioned magnet.

Additionally, conical blocking guides which however could be made small in size thus being entirely covetable by the body 11 of the steady rest and never exposed to the flow of machining fluids, could be required only in case of transverse pressure.

The flat carriage 21 is advantageously provided with a perfectly flat engagement surface 24 without any roughness.

The flat engagement surface 24 of the carriage 21 is required in that the positioning and blocking device 20 operates in a dirty environment, with ferromagnetic material mixed with ceramic material which would otherwise be capable of depositing, pushed by the magnetic force of the base 22, in any interstice available.

Therefore, in the absence of a flat surface, the deposited residues would alter the magnet control devices in their operation and thus increase the requirement of maintenance operations.

Alongside the wear and functional alteration of the magnetic engagement systems, the considerable deposit of material usually complicates and makes both the positioning and alignment operations of the steady rests 10 unrepeatable.

The perfectly flat surface 24 of the carriage 21, reduces the sedimentary accumulation of the grinding residues.

The surface 24 is obtained by exploiting the cover of the magnets zone 22, which extends in a perimeter manner to them ending up covering the entire engagement surface of the carriage 21.

Such cover 24 is preferably made continuous and made of ferromagnetic material in order to reduce the field dispersions, appearing as an extension of the magnetic gap.

Alternatively, covers made of diamagnetic or non-magnetic material can be used, even though materials of this type require a reduction of the thickness of the wall to avoid dispersions of the magnetic field.

Such watertight cover 24 separates the magnets against the work zone avoiding the passage of dirty liquids towards the engagement systems, which might cause damage or alter the operation in any case. Furthermore, lack of roughness alongside the reduction of the amount of material depositing, extremely facilitates the maintenance operations. As a matter of fact, removal of residues entrapped in the interstices present also in the blocking devices operating without magnetic elements is no longer required.

The field generation system is preferably performed by means of permanent magnets, which have higher energy saving capacities.

In particular, the permanent magnets are maintained at a fixed position and provided is a device 25 for generating a counter-field which nullifies the natural field on the body 11 of the steady rest 10.

Such configuration reduces the problem of the magnetic hysteresis caused by any intermediate means between the magnet and the steady rest.

As a matter of fact, though using solenoids or shieldable or detachable magnets, the material surrounding the blockage zone of the body 11 of the steady rest 10 would in turn become slightly magnetised further increasing the accumulation of the sediments. The possibility according to the present invention to set the amount of the field generated by the solenoids allows to take into account also the contribution of the natural polarisation of an interposed ferromagnetic material facilitating the operations of detaching the body 11 from the steady rest 10 and cleaning of the laying surface 24 of the same.

Additionally, from a maintenance point of view, the body of the steady rest 10, itself being made of ferromagnetic material, completely covers the maximum field zone 22, providing a closure path of the magnetic circuit. This provides an elevated adhesion force alongside reducing the possibility that the non-controlled magnetic fields lead to greater sediments. Mostly performing cleaning and maintenance operations under conditions of absence of field, the blocking effect of the magnetic field which would further increase the periods and costs of operations comes short.

In particular the positioning and blocking device operates as follows:

The device 25 which generates a counter-field opposite to the natural magnetic field generated by the magnets inserted in the magnetic base 22 is enabled. In such manner, the steady rest body 11 is unblocked allowing its removal end replacement.

Furthermore, the counter-field can be set in such a manner to counter any hysteresis effects in the metal covering of the magnetic base 22.

Therefore, there is the possibility to replace the steady rest 10 with another steady rest required for another type of cylinder.

Just before positioning the new steady rest 10 on the surface 21, the operator sees to, by means of a nozzle or any other similar means, cleaning the flat carriage zone 21 where the blocking of the body 11 of steady rest 10 against the magnetic base 22 occurs.

Also such cleaning operations are performed in the absence of a magnetic field, that is in the presence of the counter-field which nullifies the natural one of the magnets. In such manner extraction and disposal of the residue material resulting from the previous operation is facilitated.

Once the body 11 of the steady rest 10 has been positioned on the surface 22, the counter-field is disabled. Disabling the counter-field produced by the relative device 25 allows the natural field of the permanent magnets of the magnetic base 22 to attract the body 11 of the steady rest 10 on the centring pins 26 constraining with a force amounting to several tons regardless of the magnetic gap which varies between 0 mm and 1 mm.

Such magnetic force operates in a central zone of the flat carriage 21 preventing the impure magnetic fields from influencing the normal operation of the movement equipment of the steady rests 10.

The positioning and blocking device 20 remains in the engagement conditions all through the period of the cylinder 13 grinding operations.

At the end of the cycle, the total magnetic field is once again nullified allowing, if required, the removal and replacement of the steady rest 10.

A further cleaning operation allows simple removal of all the accumulation of dirt from the smooth walls of the magnet sealing flat zones.

Such cleaning operations, without a blockage field or substantial mechanical encumbrances, can be performed within a time reduced by 25% approximately with respect to the normal tool configuration resetting time.

In addition, through such solutions, experimental benchmark tests have proved that an overall time for the performance of all the operations on the steady rests (translation, blocking, unblocking, cleaning and configuration resetting) can be easily attained within a time reduced by 20% with respect to the traditional machines.

Therefore, the magnetic blocking system of the steady rests offers the possibility to reduce the time required for the steady rests replacement with respect to the operations performed during the traditional production process thus entailing a remarkable commercial advantage for the grinding machines provided with it.

Furthermore, such positioning and blocking devices of the steady rests do not require more than one manual intervention by a skilled operator, in particular for blocking the steady rests, thus offering the possibility of greater overall automation of the grinding process.

According to the descriptions outlined above with reference to the drawings, it is clear that a positioning and a blocking device according to the invention is particularly useful and advantageous.

Hence, the objective mentioned in the introduction of the description is attained.

Obviously, the shapes of the positioning and blocking device of the invention may differ from the ones shown strictly for exemplifying and non-limiting purposes in the drawings. Same case applies to the materials employed.

Hence, the scope of protection of the invention is delimited by the claims attached.

The invention claimed is:

1. A steady rest for a rolling cylinder, comprising:

a support body provided with a laying surface for a cylinder to be ground, the support body comprising at least two radially adjustable engagement portions for the engagement with the cylinder, the adjustable engagement portions projecting from the laying surface; and a positioning and blocking device comprising a substantially flat carriage having a flat engagement surface for the support body, said support body resting directly on said flat engagement surface, the flat engagement surface being substantially free of roughness, and magnetic blocking means accommodated in said flat carriage at said engagement surface, further comprising a translation device for translating the carriage.

2. The steady rest according to claim 1, wherein the magnetic blocking means generates a generally settable magnetic field.

3. The steady rest according to claim 2, further comprising a counter-field generating device configured to counter a natural magnetic field generated by the magnetic blocking means.

4. The steady rest according to claim 1, wherein the magnetic blocking means comprises at least one permanent magnet.

5. The steady rest according to claim 1, wherein the magnetic blocking means includes a watertight cover.

6. The steady rest according to claim 5, wherein the cover extends in a perimeter manner to the magnetic blocking means.

7. The steady rest according to claim 5, wherein the cover is made of ferromagnetic material.

8. The steady rest according to claim 5, wherein the cover is made of diamagnetic material.

9. The steady rest according to claim 5, wherein the cover is made of non-magnetic material.

10. The steady rest according to claim 5, wherein the surface is free of roughness and is made by the cover.

11. The steady rest according to claim 1, wherein the flat carriage comprises a plurality of centering pins.

12. The steady rest according to claim 1, wherein the flat carriage comprises a plurality blocking conical guides.

13. A grinding machine for rolling mill cylinders employing at least the steady rest according to claim 1 and further comprising:

radially adjustable engagement means.

14. A method for positioning and blocking a steady rest for rolling mill cylinders in grinding machines according to claim 13 comprising:

a) mounting a rolling mill cylinder into the grinding machine;

b) enabling a counter-field generating device reducing a natural magnetic field generated by the magnetic blocking means;

c) translating the steady rest moving it to a coupling position with the rolling mill cylinder;

d) disabling the counter-field generating device by magnetically blocking the steady rest against the flat carriage; and e) performing the grinding operations of the rolling mill cylinder.

15. A method according to claim 14, further comprising performing cleaning operations on the engagement surface, when the counter-field generating device is enabled.

* * * * *